US005259360A

United States Patent [19]

Panara et al.

[11] Patent Number: 5,259,360

[45] Date of Patent: Nov. 9, 1993

[54] APPARATUS FOR LAUNCHING MOVABLE DISCS OR TARGETS FOR TRAP SHOOTING

[75] Inventors: Paul Panara, Cagnes sur Mer; Jean-Michel Laporte, Biot, both of France

[73] Assignee: Laporte Ball Trap, Vauvert, France

[21] Appl. No.: 953,143

[22] Filed: Sep. 29, 1992

[51] Int. Cl.[5] ..... A63B 65/00; F41B 3/00

[52] U.S. Cl. ..... 124/50; 124/47; 124/48

[58] Field of Search ..... 124/46, 47, 45, 50, 124/49, 48, 8, 6, 4, 9; 221/242, 241

[56] References Cited

U.S. PATENT DOCUMENTS 2,711,726 6/1955 Darrell ..... 124/47
3,937,203 2/1976 Riedmueller ..... 124/47

FOREIGN PATENT DOCUMENTS 2279062 2/1976 France .
2334081 7/1977 France ..... 124/47
2419500 10/1979 France .
2493505 5/1982 France .
2587472 3/1987 France .
WO87/01191 2/1987 World Int. Prop. O. .

*Primary Examiner*—Randolph A. Reese
*Assistant Examiner*—Anthony Knight
*Attorney, Agent, or Firm*—Young & Thompson

[57] ABSTRACT

Apparatus for launching movable discs of targets for trap shooting, of the type using a rotatable barrel (2) into which are loaded movable targets (1) that are superposed on each other in columns (3, 4) maintained by vertical tubes (5), disposed between an upper plate (6) recessed for the passage of the movable targets (1) and a lower plate (7) recessed for the passage of the movable targets (1) which fall on a base plate (10) fixed against rotation, which presents each movable target (1) to a launching ramp (42) in front of the launching arm (11). The loading of the movable targets (1) takes place frontally by spacing apart the vertical tubes (5). On the base plate (10), a roller cam acts to maintain in place the next-to-last movable target, this roller cam comprising adjusting mechanism to be adapted as a function of the diameter of the targets (1) used.

6 Claims, 5 Drawing Sheets

APPARATUS FOR LAUNCHING MOVABLE DISCS OR TARGETS FOR TRAP SHOOTING

FIELD OF THE INVENTION

The invention relates to apparatus for launching movable discs or targets for trap shooting.

This sporting shooting is called "disc or clay pigeon shooting".

THE KNOWN PRIOR ART

The state of the art can be defined by the following patents:

FR-A-2.419.500: A feeder comprises a plate, a turret mounted turnably on the plate and comprised by magazines, a roller distribution device mounted on the plate, a suspended transfer assembly between the plate and the launching arm and a device for driving the transfer assembly in synchronism with the turret and the movable member.

FR-A-2.493.505: A launching apparatus for movable discs or targets is adapted to operate in an automatic manner, which is to say without manual intervention in the course of its sequential operation. According to the invention, the apparatus is constituted by an assembly of support chassis, a launching device for targets and a supply and distribution assembly for targets to this launching device. The chassis can be mounted in an oriented position and supports the device at a predetermined adjustable inclination. The assembly is adapted to turn sequentially and in coordination with the rotation of reloading of the launching device, so as to distribute a new target to the latter after each launch.

FR-A-2.587,472: A launcher and a multiformat protractor. The multiformat protractor is formed by at least two shoulders of different sizes. It is comprised by a ramp whose profile comprises at least two shoulders of different sizes adapted to the size of the targets and to the different combinations of targets with each other.

FR-A-2.279.062: Apparatus for launching discs for target shooting, of the type comprising a body in a substantially vertical bearing which turns about an axis one of whose ends carries a launching arm adapted to receive the discs to be launched, while the other end is fixed to a crank whose handle is connected to a tension spring, means to control the rotation of the axle from a motor with interposition of a speed reducer to dispose the axle in an angular position in which the arm is loaded and the traction spring stretched and means to free this latter to permit it to pivot under the action of the traction spring for launching the disc, and members for unidirectional wedging interposed between the output shaft of the reducer and the axle. Means are provided to stop said motor when the arm occupies a loaded position and is maintained in this position by wedging, and means are provided to place the motor in operation to control, on the one hand, the freeing of the arm, and on the other hand, its reloading.

These patents describe different launchers which permit solving the problems of automatic launching and reloading of the launching arm. Only one patent discloses a multiformat protractor for a non-automatic launcher.

The invention solves all the problems arising from the differences of format in the utilization of an automatic launcher.

At present, there exist principally two types of discs or clay pigeons. The French or European disc, which has a diameter of 110 mm, and the American disc, which has a diameter of 107.5 mm. The other contours and dimensions are fairly similar, only this difference of diameter giving rise to problems in the use of the same launcher.

OBJECTS OF THE INVENTION

The invention therefore has as an object to provide a single launching apparatus which can be rapidly adapted to launch American or European discs.

The apparatus according to the invention also has as an object to permit storing more discs while using, at the supply drum for the discs, ten loading columns for discs or targets. The loading of the discs or targets is effected frontally simply by separating the rods of the drum.

The apparatus according to the invention also has as an object to permit adapting very rapidly the launcher to discs of different diameter, for example for use of the launcher in the United States or in Europe.

SUMMARY OF THE INVENTION

To this end, the apparatus for launching clay pigeons or movable targets for trap shooting is of the type using a rotating drum on which are loaded the movable targets, the movable targets are superposed on each other, in columns maintained by tubes or vertical rollers disposed between an upper recess plate or radiating arms for the passage of the movable targets and a lower recess plate for the passage of movable targets which fall on a base plate fixed in rotation therewith, which presents each movable target on a launching ramp in front of the launching or ejection arm, one or several motors ensuring the rotation of the rotatable drum and the movement of the ejection arm, wherein the loading of the movable targets takes place frontally by spacing of the upper ends of the vertical tubes, from which the retractable securement means permit a disengagement of the upper plate, by rotation of the ends of the tubes or vertical rollers on their securement insert, it is possible to vary the distance between two adjacent tubes to adapt the column of movable targets as a function of the diameter used, and upon the discharge of the movable targets onto the base plate, a roller cam acts to maintain in place the next-to-last movable target and to let fall by gravity the last target of the column onto the base plate, then onto the launching ramp, said roller cam comprising adjustment means adapted to be adjusted as a function of the diameter of the targets used.

The vertical tubes are provided at their upper end with a retractable centering means mounted coaxially of a return spring. The centering means is mounted coaxially to the longitudinal axis of the vertical tube. The centering means enters an opening provided for this purpose in the upper plate of the rotatable drum. The opening comprises two notches or oblong lateral holes which permit, after retraction of the centering means, the displacement of the tube from the vertical.

The vertical tubes comprise, at their surface, grooves of different sizes and shapes, adapted to different diameters used for the movable targets and, at their lower end, a recess for an insert for maintaining integrally the lower plate, after dismounting the centering means from the vertical tube or roller, a rotation of the tube on the insert permitting selecting the groove which will be in contact with the target.

The insert has a male pentagonal shape, and the recess for the tube has a female pentagonal shape.

The roller cam is disposed at the periphery of the rotatably fixed base plate, where the barrel releases the movable targets one by one.

This cam is kidney shaped. At one end, the cam is articulated in rotation in a horizontal plane, about an axle which can be disposed at several locations on the base plate and this as a function of the diameter of the target used, the other end is articulated to a contact arm which presses said cam outwardly of the base plate, against the targets, said contact arm acting by means of springs, and its pressure on the cam being regulable. The convex portion of the cam is provided with rollers which are in contact with the passing targets.

Not only are the diameters of certain types of targets different, but their thickness may also be different.

To this end, the launching ramp can receive a means serving as a wedge which compensates the difference in thickness between conventional targets and other targets.

BRIEF DESCRIPTION OF THE DRAWINGS

The accompanying drawings are given by way of illustrative examples and are non-limiting. They show a preferred embodiment according to the invention, they will permit easily understanding the invention. In the drawings.

Likewise, the lower plate is shown in broken lines in profile, so as to illustrate the openings for the passage of targets onto the base plate.

Figure 3:
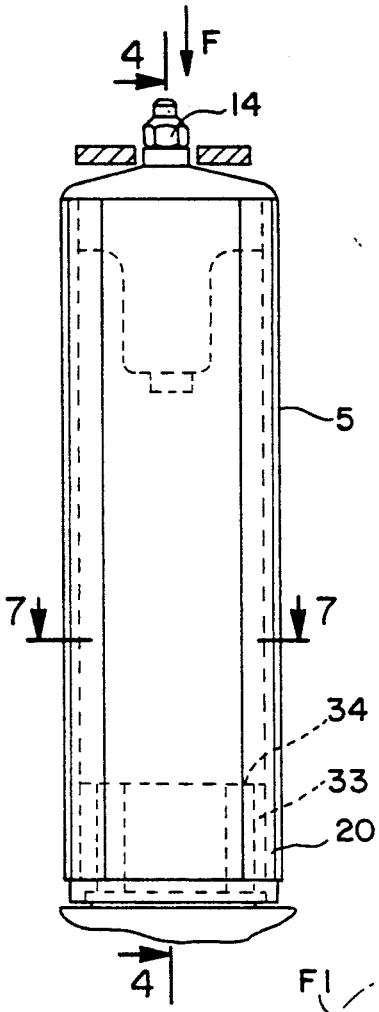

FIG. 3 is a side view of the tube or roller for securing the targets.

Figure 4:
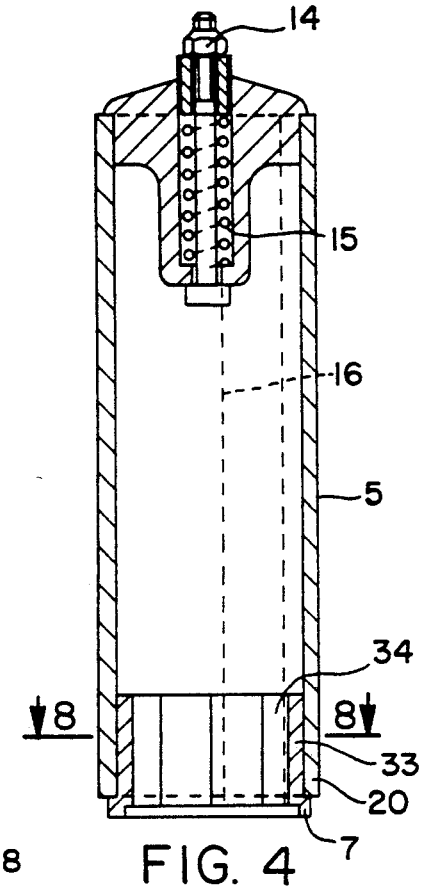

FIG. 4 is a cross section of said roller on the axis 4—4, which is the longitudinal axis shown in FIG. 3.

Figure 5:
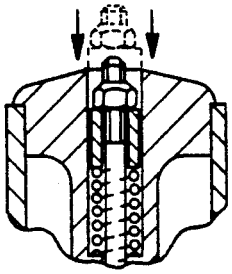

FIG. 5 is a cross-sectional view of a detail, of the upper end of the tube or roller, showing the retraction of the centering means for positioning the tube or roller.

Figure 6:
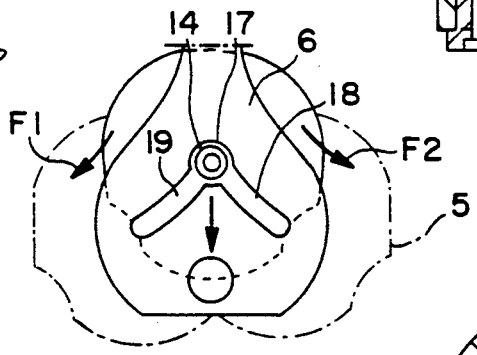

FIG. 6 is a top plan view of the upper plate showing the opening provided in said upper plate of the barrel, as well as the two lateral slots or oblong holes which permit the lateral disengagement of the tube or roller.

Figure 7:
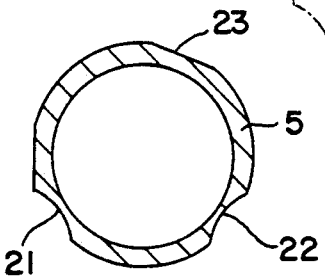

FIG. 7 is a cross-sectional view on the transverse axis 7—7 shown in FIG. 3.

Figure 8:
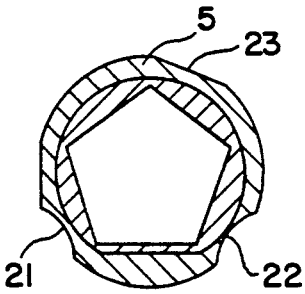

FIG. 8 is a cross-sectional view of the lower end of the roller, taken on the line 8—8 of FIG. 4, showing the recess of the tube or roller and the securement insert of pentagonal shape.

Figure 1:
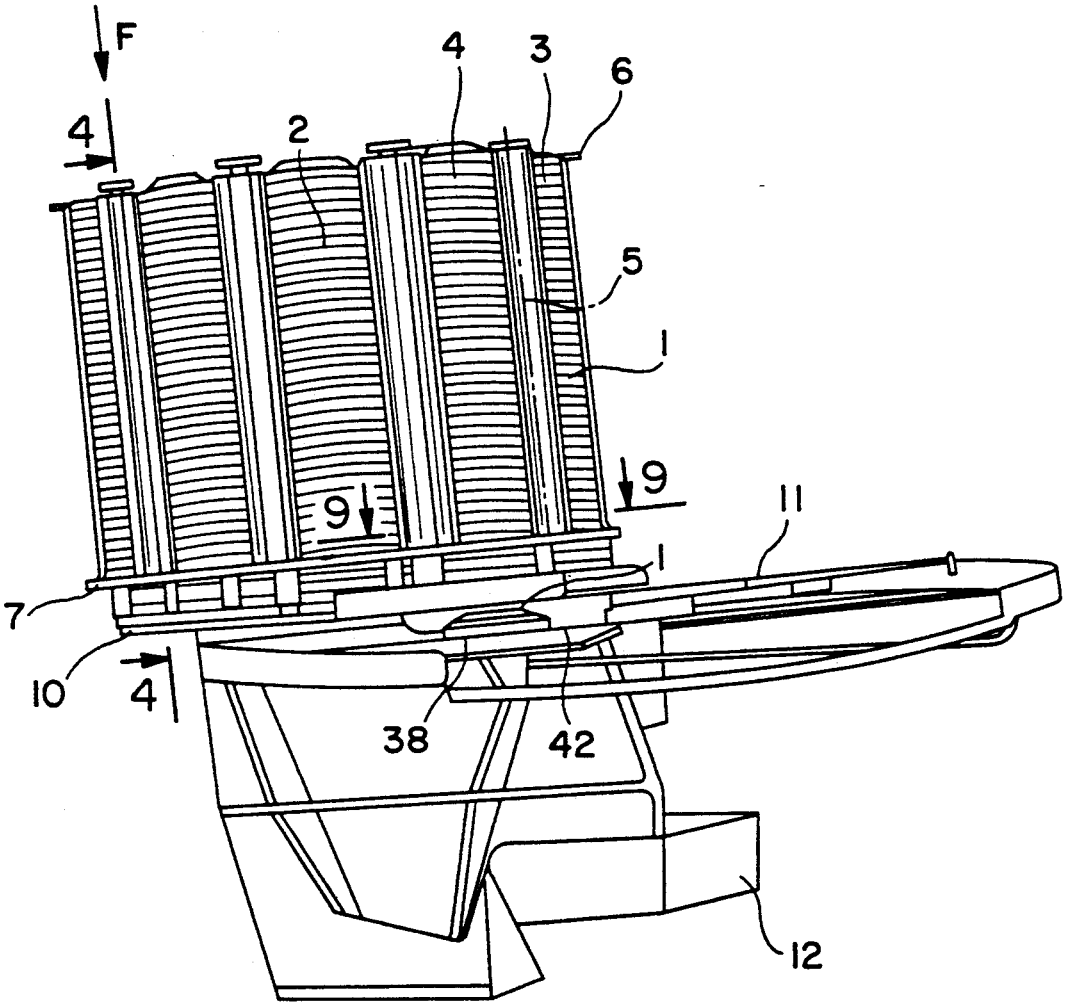
FIG. 1 is a perspective view of the launcher according to the invention.
Figure 2:
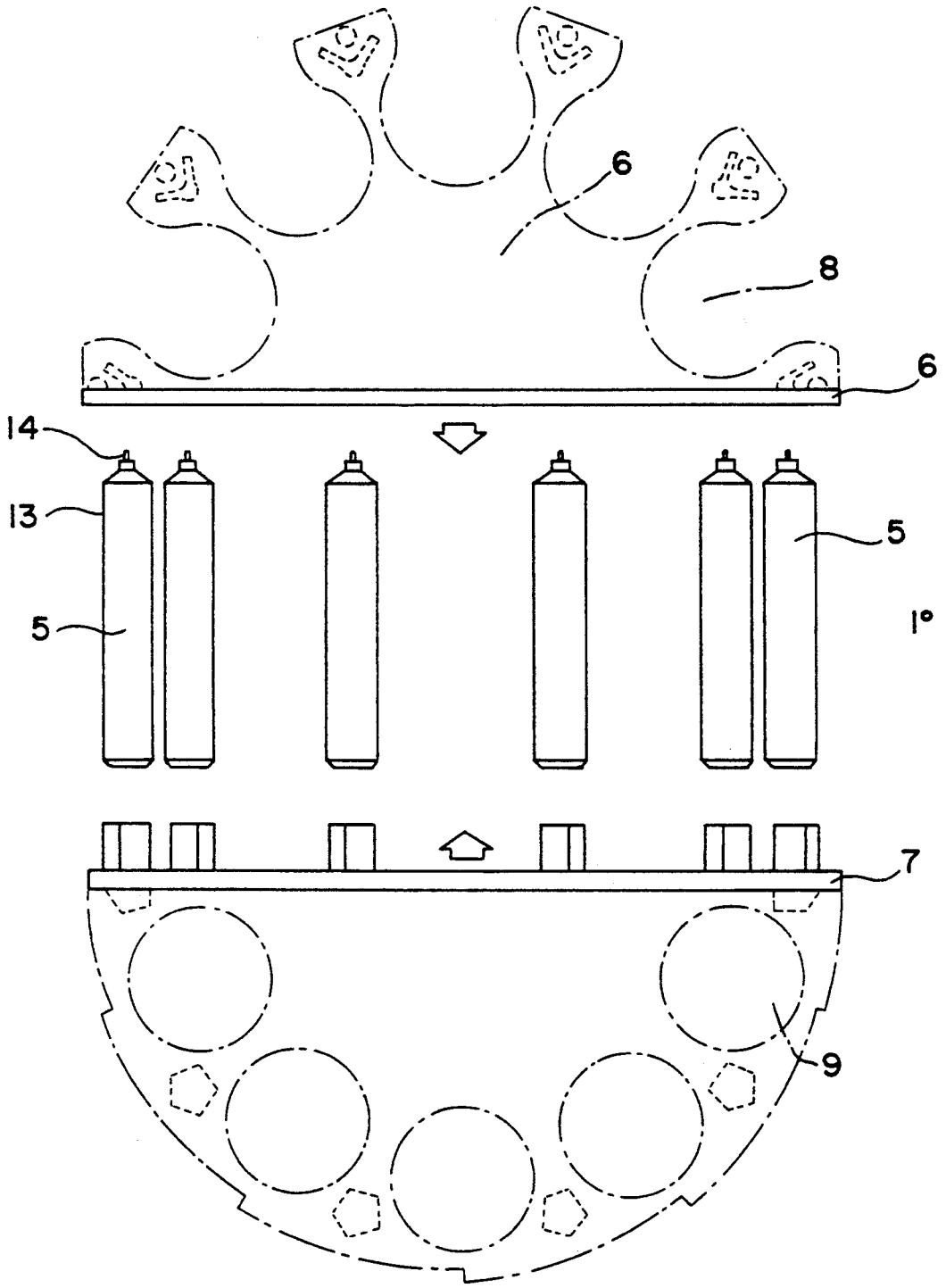
FIG. 2 is an exploded side view of the barrel showing the upper plate for maintaining the rollers or tubes and the lower plate for maintaining the rollers or tubes. In the same figure in broken lines, the upper plate, shown in profile, has been shown and this so as to illustrate the recesses for the passage of targets, during filling.
Figure 9:
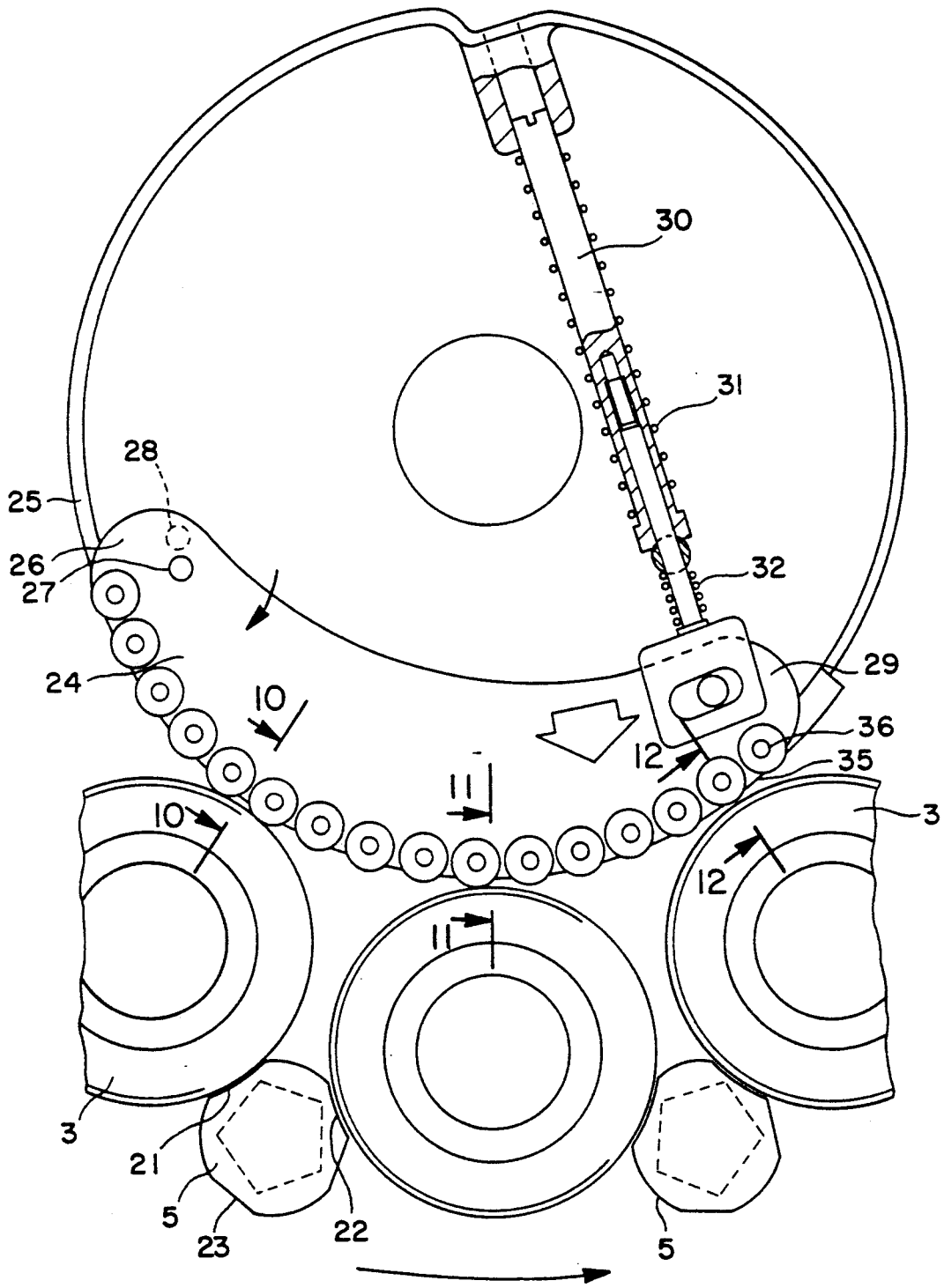

FIG. 9 is a top plan view taken on the line 9—9 in FIG. 1, showing the base plate fixed in rotation, the roller cam, the movable targets and the guide rollers.

Figure 10:
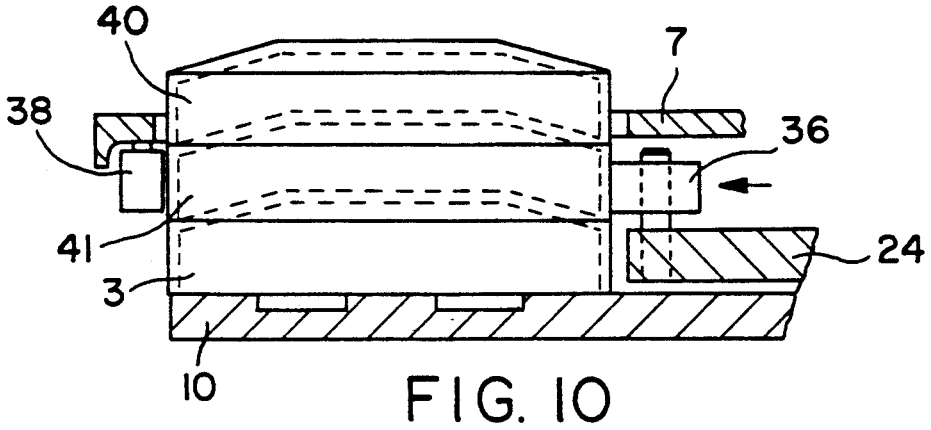

FIG. 10 is a cross-sectional view on the axis 10—10, shown in FIG. 9. It shows the lower plate for maintaining the rollers, the roller cam, the base plate, the last target which falls by gravity onto the base plate, the last target of the column which remains in place and the next-to-last target which also remains held.

Figure 11:
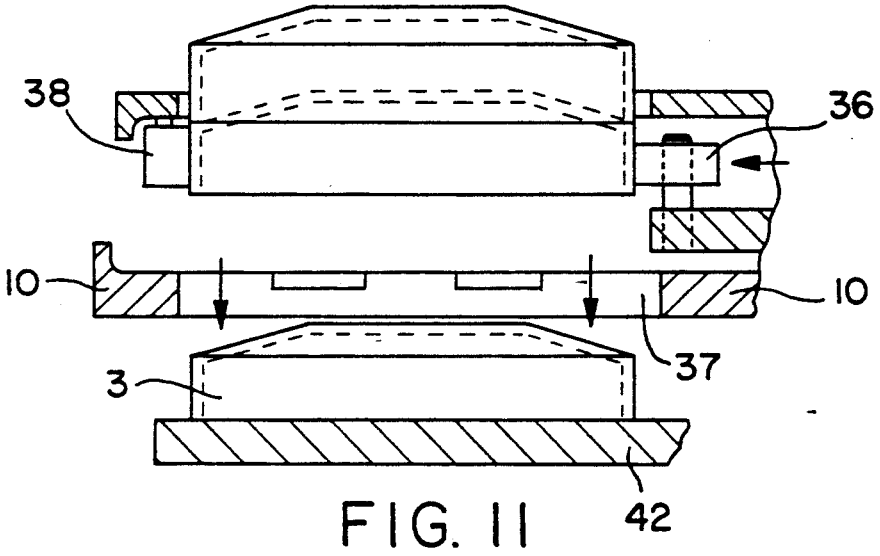

FIG. 11 is a view according to FIG. 10, on the line 11—11 in FIG. 9, in which the free target is disengaged from the column of targets, ready to be ejected.

Figure 12:
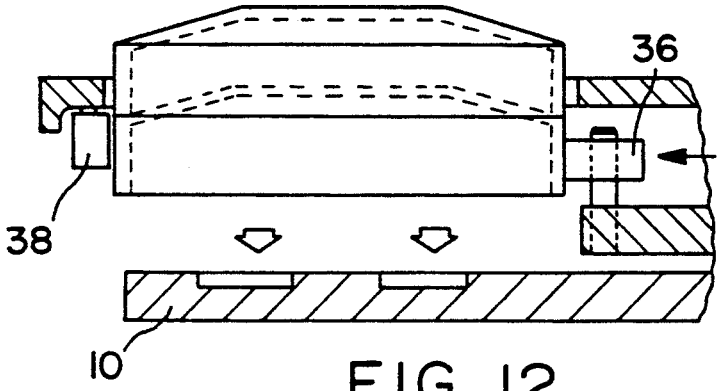

FIG. 12 is a cross-sectional view of FIGS. 10 and 11, on the line 12—12 in FIG. 9, in which the free target has been ejected.

DETAILED DESCRIPTION OF THE INVENTION

In FIG. 1, the apparatus for launching clay pigeons or movable targets 1 for trap shooting is of the type using a rotatable barrel 2 into which are loaded the movable targets 1.

The movable targets 1 are superposed on each other in columns 3, 4, maintained by vertical tubes or rollers 5.

In the embodiment shown in FIG. 1, there are ten tubes or vertical rollers 5.

These vertical rollers 5 are disposed between an upper plate 6 for maintaining the rollers 5 and a lower plate 7 for maintaining the rollers 5. The upper plate 6 comprises recesses 8 for the passage of targets 1 during filling.

In other embodiments, not shown in the figures, the plate 6 can be replaced for example by radiating arms which laterally maintain the targets 1.

The lower plate 7 comprises openings 9 permitting the passage of the movable targets which fall on the base plate 10. The base plate 10 is fixed against rotation and presents each movable target 1 before the launching arm 11 or ejection arm.

One or several motors 12 ensure the rotation of the rotatable drum 2 and the movement of the ejection arm 11. According to a particular embodiment of the invention, the loading of the movable targets 1 takes place frontally by spacing apart the upper ends 13 of two adjacent rollers 5 whose securement means 14 are retractable, so as to permit a lateral displacement of said vertical rollers 5 from the vertical.

The vertical tubes or rollers 5 are provided with retractable securement means 14. This retractable securement means 14 is a retractable centering means 14, mounted coaxially of a return spring 15. The retractable centering means 14 is mounted coaxially of the longitudinal axis 16 of vertical tube 5. The retractable centering means 14 comes into engagement in an opening 17 provided for this purpose in the upper plate 6 of the rotatable barrel 2.

The opening 17 provided for the retractable centering means 14 comprises two slots 18 and 19, or oblong lateral holes, which permit after retracting the centering means 14 the displacement of the tube 5 from the vertical.

The displacement, such as shown in FIG. 6, can take place along the arrows F1 or F2 shown in this same FIG. 6.

According to another embodiment, shown in FIGS. 3, 4, 5, 6, 7 and 8, by rotation of the lower ends 20 of the tubes 5 on their securement insert, it is possible to vary the interaxial distance between two adjacent tubes 5 to adapt the column of movable targets 3 as a function of the diameter of the targets used.

To this end, the vertical tubes 5 comprise at their surface grooves 21, 22, 23 of different shape and size to adapt the distance between the columns as a function of the diameter of the targets used.

To this end, at the lower end 20 of the vertical tube or roller 5, a recess 33 is provided for a securement insert 34. The securement insert 34 is fixed to the lower plate 7.

Thus, after disconnecting the centering means 14 from the vertical tube 5, it is possible by rotation of the tube 5 to select a groove 21 or 22 or 23 which will be in contact with the edge of the target 1.

According to an embodiment shown in the figures, the recess 33 of the vertical tube 5 has a female pentagonal shape.

The insert 34 has a male pentagonal shape.

The grooves 21, 22, 23 are disposed on the generatrix of the vertical tube 5.

A roller cam 24 is disposed at the periphery 25 of the base plate 10, fixed in rotation, where the barrel 2 releases one by one the movable targets 1.

Said roller cam 24 is of kidney shape.

At one end 26, the roller cam 24 is articulated in rotation in a horizontal plane about an axle 27 which can be disposed at several positions 27 or 28 on the base plate 10 and this as a function of the diameter of the target 1 used. This pivoting axle 27 is therefore adjustable to positions 27 or 28.

The other end 29 of the roller cam 24 is articulated to a contact arm 30 which presses said cam 24 outwardly of the base plate 10, against the targets 1.

Said contact arm 30 acts by means of springs 31, 32 which ensure an adjustable pressure on the roller cam 24. The convex portion 35 of the roller cam 24 is provided with rollers 36 which are in contact with the edge of the targets 1 which pass in front of the roller cam 24.

FIGS. 10, 11 and 12 show the freeing of the last target 1 onto the base plate 10 and this in a manner such that it will be ejected by the launching or ejection arm 11.

In FIGS. 10, 11 and 12 will be seen the lower plate 7 for maintaining the vertical rollers or tubes 5. This lower plate comprises openings 9 which permit the passage of the targets which descend by gravity. At the end 29 of the roller cam 24, the base plate 10 comprises an opening 37 which permits one of the movable targets I to be freed, because it is not in contact with another roller, and to fall on the base plate 10. For this purpose, the column 4 of targets 1 is maintained, as to the last target 1, by the base plate 10, for the next-to-last target 41, by the contact rollers 36 of the roller cam 24 and, outwardly, by an external maintenance roller 38, the next-to-next-to-last target 40 is also maintained, because the next-to-last target 41 is maintained. Only the last target 1 is freed.

Arriving at the recess 37 of the base plate 10, the freed target I falls from the base plate 10 onto the launching ramp 42. The next-to-last target 41, which is maintained by the rollers 36 and 38 and the next-to-next-to-last target 40 is also maintained in place in the barrel 2.

The launching apparatus can be easily adapted for the use of different types of targets.

Thus, there are targets whose diameters are various, as well as their name.

| | | |
|---|---|---|
| In France: | "mini" target | ϕ 90 mm |
| | "bourdon" target | ϕ 60 mm |
| In England: | "midi" target | ϕ 90 mm |
| | "mini" target | ϕ 60 mm. |

These differences of diameter give rise to no problem in the use of the apparatus, given the technical characteristics described above.

Other targets have different thicknesses, for example: "BATTUE" (trademark) target Φ110 mm, with a thickness half the normal thickness.

In this case, the launching ramp 42, which is on an inclined plane, can receive a means serving as a wedge, which compensates the difference of thickness between the conventional target and the others and can be specific to this or that firing or sport.

We claim:

1. In apparatus for launching clay pigeons or movable targets (1) for trap shooting, of the type using a rotatable barrel (2) into which are loaded the movable targets (1); the movable targets (1) being superposed on each other, in columns (3, 4), maintained by vertical tubes or rollers (5), disposed between an upper member (6) for the passage of the movable targets (1) and a lower recessed plate (7) for the passage of the movable targets (1) which fall on a base plate (10) fixed against rotation, which presents each movable target (1) to a launching ramp (42) in front of an ejection arm (11), there being motor means to effect the rotation of the rotatable drum (2) and the movement of the ejection arm (11); the improvement wherein the loading of the movable targets (1) is performed frontally by spacing apart the upper ends (13) of the vertical tubes (5), which have retractable securement means (14) permitting disengagement from the upper member (6), by rotation of the ends (13) of the vertical tubes or rollers (5) on their securement insert (34) it is possible to vary the distance between two adjacent tubes (5) to adapt said distance between the tubes to the columns (3, 4) of movable targets (1) as a function of the diameter of the targets being used, and at the point of escape of the movable targets (1) onto the base plate (10), a roller cam (24) acts to maintain in place the next-to-last movable target (41) and to let fall by gravity the last target (1) of the column (3, 4) onto the base plate (10), then through an opening (37) in the base plate and onto a launching ramp (42), said roller cam (24) comprising adjustment means (27, 28) adjustable as a function of the diameter of the targets (1) used.

2. Apparatus according to claim wherein the vertical tubes (5) are provided at their upper end (13) with retractable centering means (14) mounted coaxially of a return spring (15); the centering means (14) is mounted coaxially of the longitudinal axis of the vertical tube (5); the centering means (14) enters an opening (17) provided for this purpose in the upper member (6) of the rotatable drum (2); the opening (17) comprises two lateral slots (18, 19) which permit, after retraction of the centering means (14), the displacement of the tube (5) from the vertical.

3. Apparatus according to claim 2, wherein the vertical tubes (5) comprise on their surface grooves (21, 22, 23) of different sizes and shapes, adapted to the various diameters used for the movable targets (I) and at their lower end (20), a receiver (33) for an insert (34) to maintain fixedly the lower plate (7); and wherein after dismounting the centering means (14) from the vertical tube or roller (5), a rotation of the tube (5) on the insert (34) permits choosing the groove (21, 22 or 23) which will be in contact with the target (1).

4. Apparatus according to claim 3, wherein the insert (34) has a male polygonal shape, and the receiver (33) of the tube (5) has a complementary female polygonal shape.

5. Apparatus according to claim 1, wherein the roller cam (24) is disposed at the periphery (25) of the base plate (10) which is fixed against rotation, and wherein the barrel (2) frees one by one the movable targets (1).

6. Apparatus according to claim 5, wherein said cam (24) is of kidney shape; at one end (26) the cam (24) is articulated about an axle (27) for rotation in a horizontal plane which can be disposed in several positions (27, 28) on the base plate (10) as a function of the diameter of the target (1) used, the other end (29) of said cam (24) being articulated to a contact arm (30) which presses said cam (24) outwardly of the base plate (10), against the targets (1), said contact arm (30) acting by means of springs (31, 32) and its pressure on the cam (24) being adjustable; a convex portion (35) of the cam (24) being provided with rollers (36) which are in contact with the targets (1) which pass by.

* * * * *